US006074291A

United States Patent [19]

Chang et al.

[11] Patent Number: 6,074,291

[45] Date of Patent: Jun. 13, 2000

[54] APPARATUS FOR PREPARING ULTRA-THIN SPECIMEN

[75] Inventors: Wen-Tung Chang, Hsinchu; Chao-Hsi Chung, Hsinchu Hsien, both of Taiwan

[73] Assignee: Mosel Vitelic, Inc., Taiwan

[21] Appl. No.: 09/250,952

[22] Filed: Feb. 16, 1999

[30] Foreign Application Priority Data

Nov. 2, 1998 [TW] Taiwan ..... 87118218

[51] Int. Cl.[7] ..... B24B 41/06

[52] U.S. Cl. ..... 451/391; 451/405

[58] Field of Search ..... 451/391, 364, 451/386, 405, 389, 390, 404

[56] References Cited

U.S. PATENT DOCUMENTS 3,867,797 2/1975 Meier ..... 451/405
4,625,460 12/1986 Burgess et al. ..... 451/278
4,876,826 10/1989 Denboer ..... 451/364
5,272,844 12/1993 Burgess et al. ..... 451/405

FOREIGN PATENT DOCUMENTS 403190225 8/1991 Japan ..... 451/364

*Primary Examiner*—Robert A. Rose
*Attorney, Agent, or Firm*—Madson & Metcalf

[57] ABSTRACT

An apparatus for preparing an ultra-thin specimen with a polishing wheel is developed. The apparatus includes a base, a holding unit mounted on the base and having a movable part for supporting the specimen, and an adjusting assembly attached to the base for adjusting an orientation of the specimen relative to a top surface of the polishing wheel by providing a fine movement during polishing. The movable part of the holding unit is advantageously moved away from the adjusting assembly to enlarge the latitudinal cross-section of the apparatus so as to increase the precision of the orientation.

13 Claims, 9 Drawing Sheets

APPARATUS FOR PREPARING ULTRA-THIN SPECIMEN

FIELD OF THE INVENTION

The present invention relates to an apparatus for preparing an ultra-thin specimen with a polishing wheel, and more particularly to an apparatus for preparing an ultra-thin specimen to be examined under a microscope with a high magnification.

BACKGROUND OF THE INVENTION

In the semiconductor industry, it is common to use a scanning electron microscope (SEM) to observe the surface condition of a deposited wafer and transmission electron microscope (TEM) to examine the microstructure of a deposited wafer to ensure that finished microelectronic elements satisfy an expected standard. At first, a sample is cut from a wafer to be examined. After thoroughly polished, the sample becomes ultra-thin and is ready to be examined by an electron microscope for determining the quality of the wafer.

Conventional polishing tools for preparing an ultra-thin specimen are designed in accordance with the principle of three points deciding a plane. Nowadays, there are several companies manufacturing different kinds of polishing tools, such as South Bay Tech. and Allied Inc., etc. However, there exists several shortcomings in conventional polishing tools:

(a) conventional polishing tools are too heavy to be handled, mainly because there are made of copper or stainless steel, (b) conventional polishing tools have two Teflon-made footing pieces, which are difficult to be effectively positioned or have to utilize a micrometer during polishing a specimen. That brings about the increased cost and size of a conventional polishing tool. Further, a conventional polishing tool is usually made in such a way that the specimen to be polished is placed far away from Teflon-made footing pieces in order to secure a uniformity in thickness of the specimen. It results in an increase in the height of a polishing tool and thus is inconvenient for a user to place a conventional polishing tool on the stage of an optical microscope for primary examination.

(c) It is common for any conventional polishing tool to use a holder to position a specimen. Since the holder used is immobile, it is unable to increase the accuracy of the specimen mounted on the holder. On the other hand, a cross section specimen for TEM observation is different from a plane view specimen for SEM observation. The prior design has to use different holders with varied shapes, instead of a single holder, for different types of specimens. Please refer to FIGS. 1 and 2 which are schematic diagrams showing a conventional L-shaped holder 11 and a conventional H-shaped holder 12, respectively.

FIG. 3 illustrates a polishing wheel 13 for polishing a specimen 14 stuck to an L-shaped holder 11. FIG. 4 illustrates a polishing wheel 13 for polishing a specimen 14 stuck to an H-shaped holder 12. A fine distance Δ shown in FIG. 3 is measured with a micrometer (not shown). By using an optical microscope 15 shown in FIG. 5, a user may monitor the advanced cross-sectional line of the polished specimen 14. It can be seen from FIG. 5 that the length of the L-shaped holder 11 is limited by the distance between the lens and the stage of the optical microscope 15. However, a shorter L-shaped will lead to a difficulty in controlling the orientation of the specimen 14 relative to the top surface of the polishing wheel 13, results in a less accuracy of controlling the thickness of the specimen 14. FIG. 6 shows the H-shaped holder 12 placed on the stage of an optical microscope for examination.

Both AMER Co. and Precision TEM Inc. have developed polishing tools similar to the polishing tool 10 as shown in FIGS. 1 and 2. However, those polishing tools have a shortcoming of above-mentioned (c). Furthermore, the prior polishing tools with a steel-made stopper 17 which is used as a fixer for a rotary bolt 18 is subject to deformation and will hurt a user's fingers during polishing.

Thus, it is tried by the applicant to deal with the situation encountered with the prior art.

SUMMARY OF THE INVENTION

An object of the present invention is to provide a polishing apparatus with a fine distance measuring unit to obtain the similar accuracy as using a micrometer.

Another object of the present invention is to provide a novel holder for polishing plane view specimen and cross-section specimen.

Another object of the present invention is to provide a novel Teflon-made footing pieces for accurately controlling the thickness of a specimen during polishing.

Another object of the present invention is to provide a non-skid bolt for accurately controlling the displacement of the footing pieces.

According to one aspect of the present invention, the apparatus for preparing an ultra-thin specimen with a polishing wheel includes a base, a holding unit mounted on the base and having a movable part for supporting the specimen, and an adjusting assembly attached to the base for adjusting an orientation of the specimen relative to a top surface of the polishing wheel by providing a fine movement during polishing.

In a preferred embodiment, the movable part of the holding unit is moved away from the adjusting assembly to enlarge the latitudinal cross-section of the apparatus so as to increase the precision of the orientation.

In another preferred embodiment, the base, the holding unit, and the adjusting assembly are combined to form a T-shaped polishing tool.

More preferably, the holding unit includes a groove for accommodating the movable part.

More preferably, the movable part is in a shape of L and has a slot for fixing the movable part to the holding unit by a screw through the slot.

More preferably, the specimen is adhered to a first side of the movable part so as to polish a top surface of the specimen.

More preferably, the specimen is adhered to a second side of the movable part so as to polish a side surface of the specimen.

More preferably, the adjusting assembly includes a screw bolt having a cylindrical bolt head circumferentially arranged with a plurality of fine grooves on a cylindrical surface of the bolt head and a rod with fine pitch for providing a fine movement during polishing the specimen, a matching piece for engaging with one of the plurality of fine grooves to fix a position of the screw bolt, and a footing piece having a tail cone at one end which is contacted with the lower end of the screw bolt by point to surface such that the footing piece is urged by the screw bolt in a forward direction to adjust the orientation of the specimen relative to the top surface of the polishing wheel.

More preferably, a coil spring is connected underneath a flange of the footing piece to urge the footing piece in a linear reverse direction by a relieving motion.

More preferably, the footing piece has a cross-sectionally T-shaped and is made of Teflon.

More preferably, the matching piece is a spring leaf made of copper.

More preferably, the screw bolt is a non-skid bolt.

The present invention may best be understood through the following description with reference to the accompanying drawings, in which:

DETAILED DESCRIPTION OF THE PREFERRED EMBODIMENTS

The present invention will now be described more specifically with reference to the following embodiments. It is to be noted that the following descriptions of preferred embodiments of this invention are presented herein for purpose of illustration and description only; it is not intended to be exhaustive or to be limited to the precise form disclosed.

Figure 7:
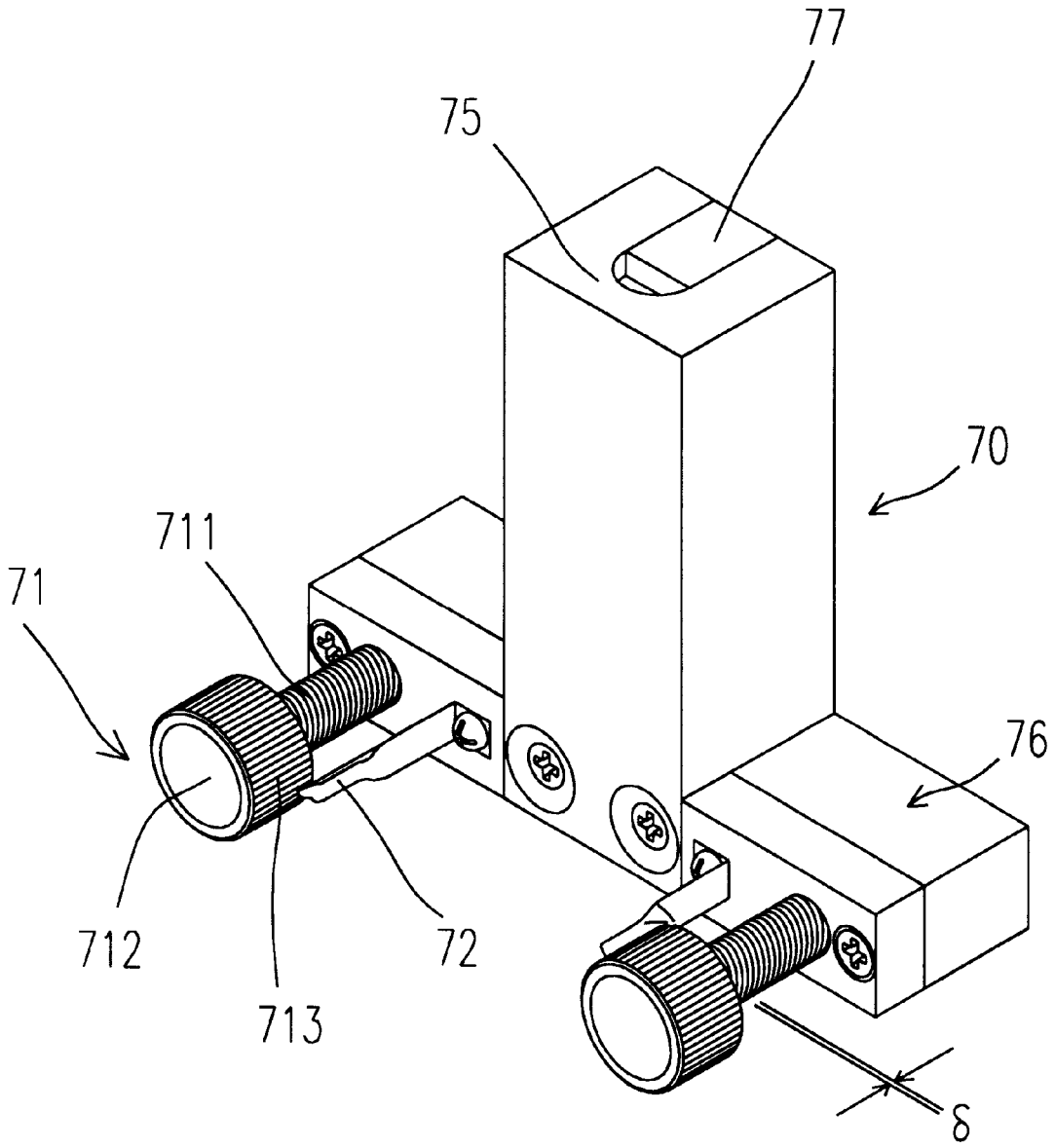
FIG. 7 is a front perspective view showing a T-shaped polishing tool according to the present invention.

FIG. 7 shows an assembled T-shaped polishing tool 70 according to the present invention. A specimen 14, cut from a metal-oxide-semiconductor chip having multiple interconnected metal layers, can be stuck to one side of the L-shaped holder 77 of the holding unit 75 and polished by a polishing wheel 13. The thinned specimen 14 is then examined under an optical microscope, a scanning electron microscope (SEM), or a transmission electron microscope (TEM).

Figure 1:
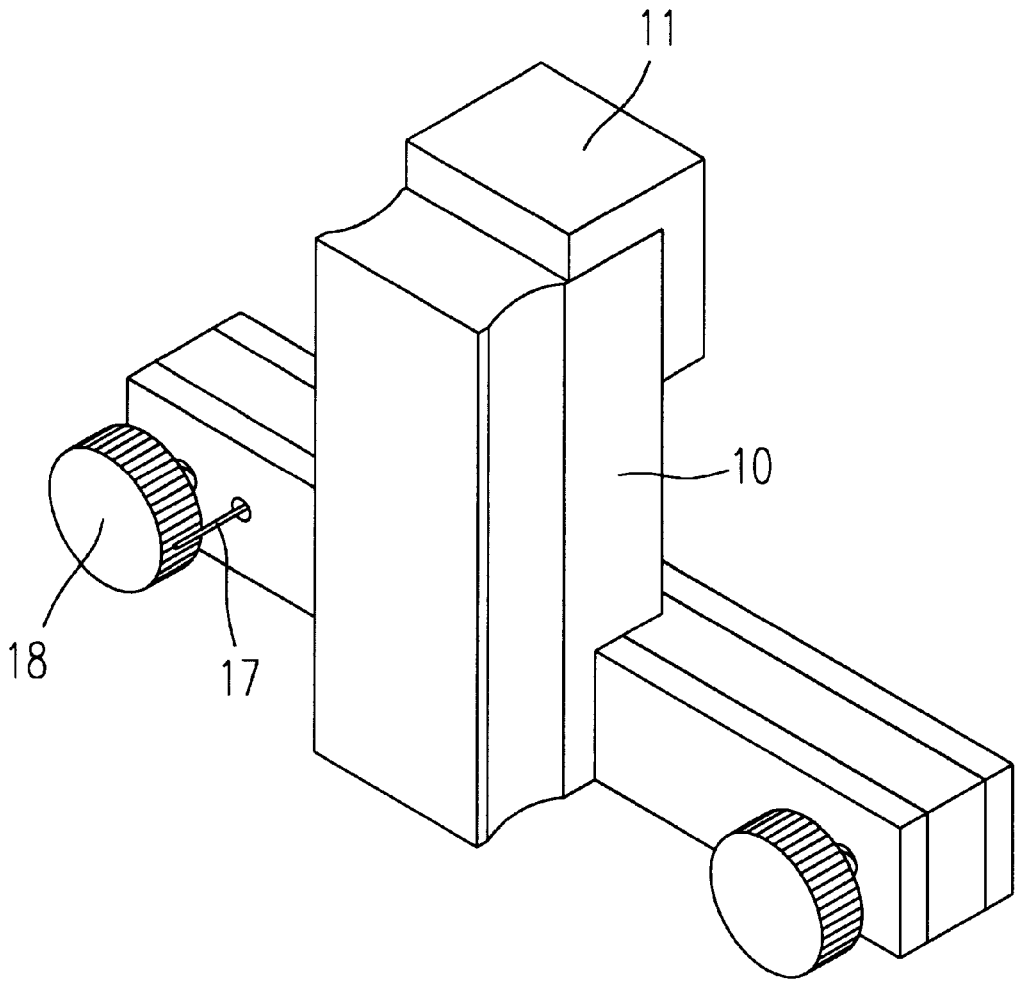
Fig. 1(PRIOR ART)
FIG. 1 is a perspective view showing a prior polishing tool with an L-shaped holder.
Figure 2:
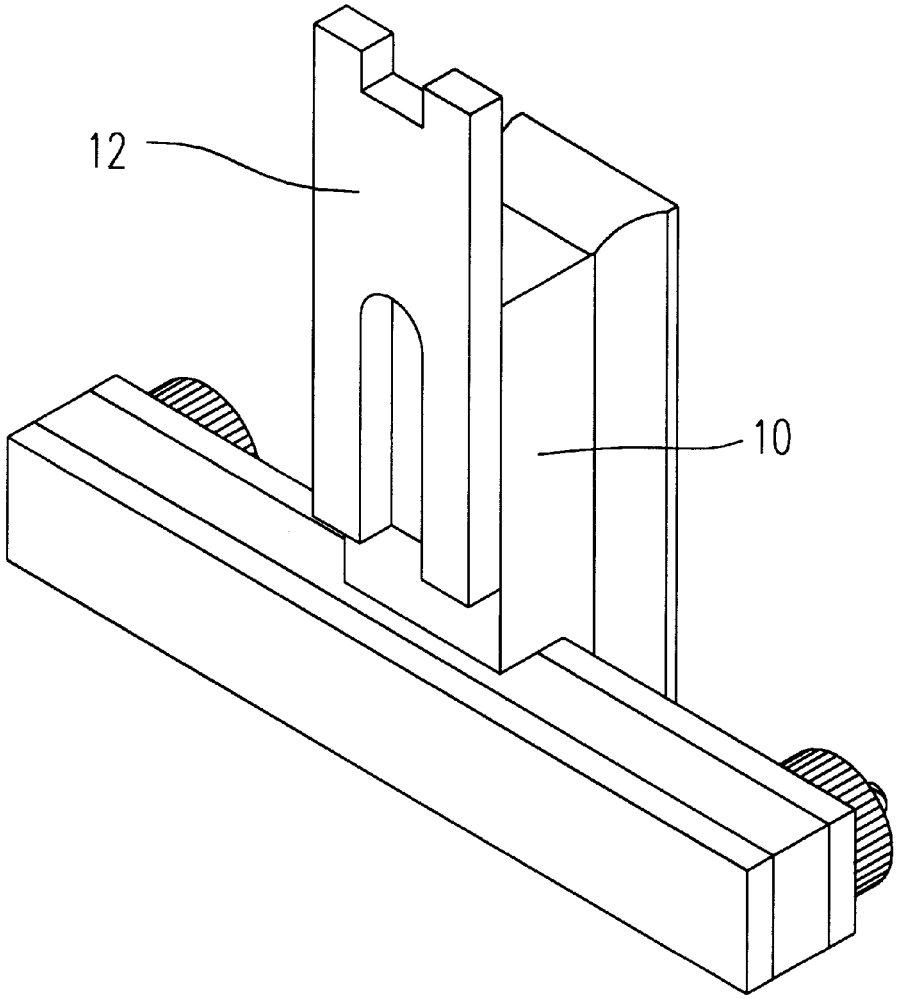
Fig. 2(PRIOR ART)
FIG. 2 is a perspective view showing a prior polishing tool with an H-shaped holder.
Figure 3:
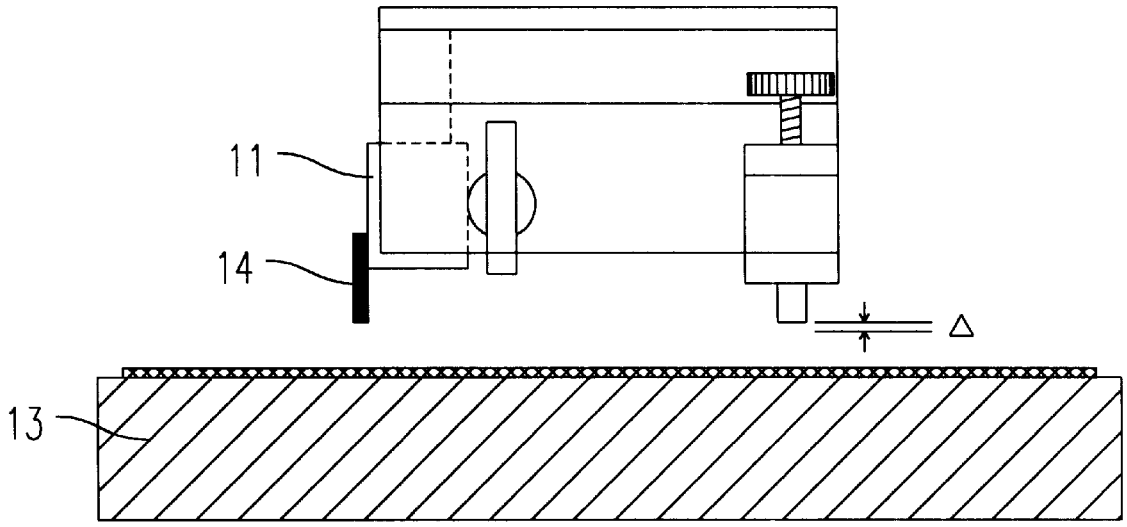
Fig. 3(PRIOR ART)
FIG. 3 is a schematic diagram showing a polishing action of the polishing tool in FIG. 1.
Figure 4:
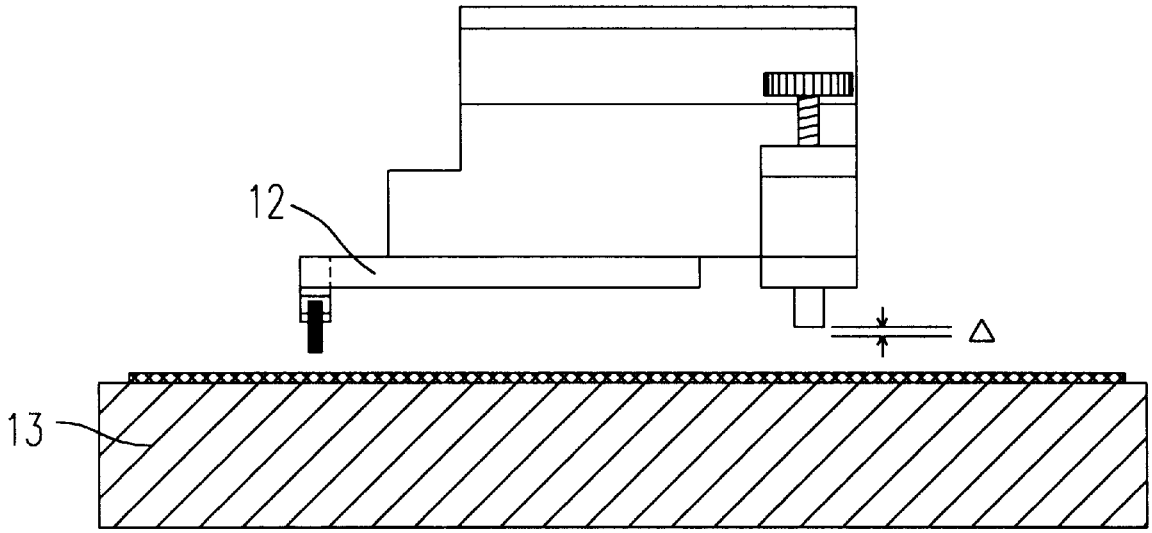
Fig. 4(PRIOR ART)
FIG. 4 is a schematic diagram showing a polishing action of the polishing tool in FIG. 2.
Figure 5:
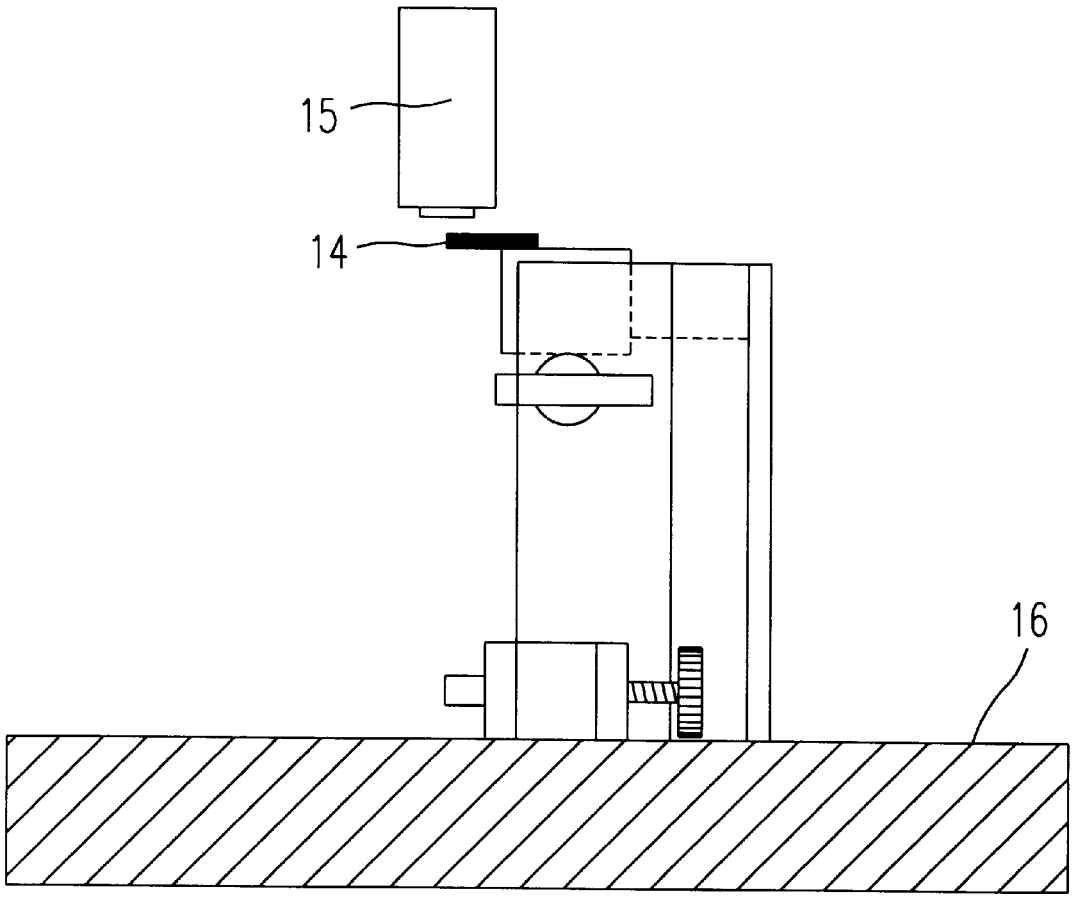
Fig. 5(PRIOR ART)
FIG. 5 is a schematic diagram showing how to use an optical microscope to monitor the advancing cross-sectional line of the specimen stuck to the L-shaped holder in FIG. 1.
Figure 6:
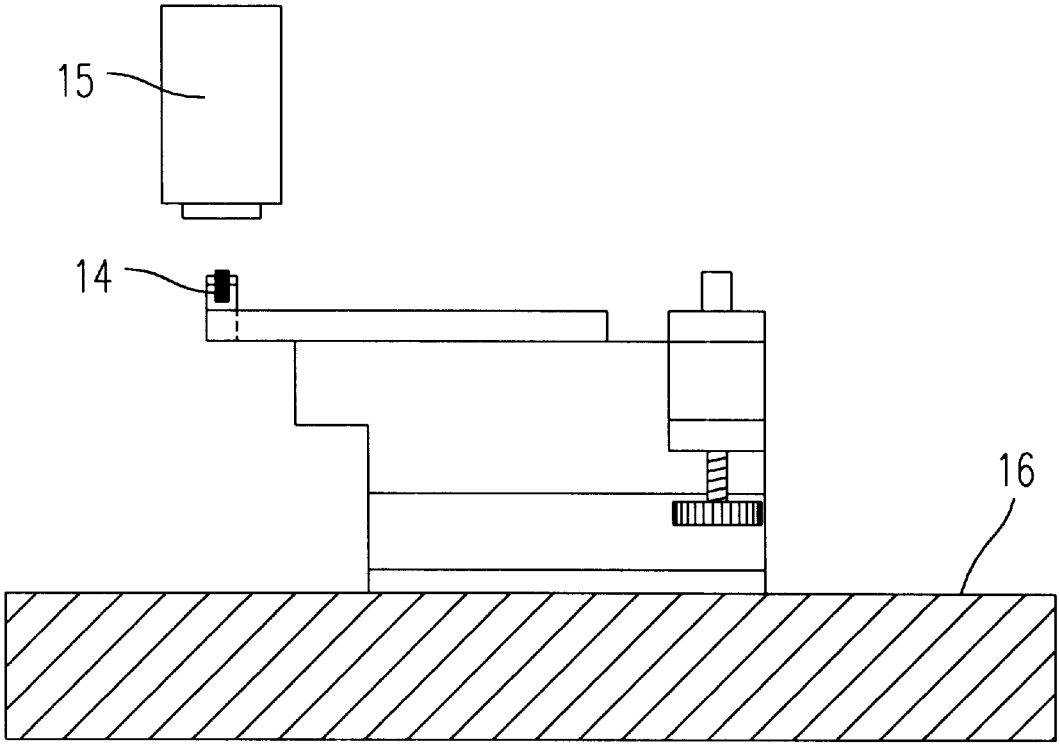
Fig. 6(PRIOR ART)
FIG. 6 is a schematic diagram showing how to use an optical microscope to examine the wedge angle of the specimen stuck to the H-shaped holder in FIG. 2.

The polishing tool 70 includes an adjusting assembly to detect a fine distance $\Delta$ A (see FIG. 3 or FIG. 5) for finely controlling the thickness of the specimen 14 during polishing. The thickness of a polished specimen is typically about 10–20 $\mu$m. The adjusting assembly includes a screw bolt 71, which is a non-skid bolt, having a cylindrical bolt head 712 circumferentially arranged with a plurality of fine grooves 713 on a cylindrical surface of the bolt head 712 for desirably controlling the rotating angle of the bolt head 712. The rod 711 of the screw bolt 71 is threaded with fine pitch $\delta$. By using the threaded screw bolt 71 with fine pitch $\delta$ for forward and backward motion, the obtained accuracy is same as that of using a micrometer. A matching piece 72 engaged with one of the plurality of fine grooves 713 is used to fix the position of the screw bolt 71.

The polishing tool 70 is made of light metal, such as aluminum, so that it is very light and handy. The matching piece 72 for engaging with one of the plurality of fine grooves 713 on the cylindrical surface of the screw bolt 71 is a spring leaf made of copper. The matching piece 72 is functioned as a stop fixer. The stripe pinking on the cylindrical surface has a sense of beauty and is convenient to be rotated. Besides, a user may easily calculate the depth of feeding during polishing from the relationship between the amount of fine grooves 713 and the pitch $\delta$ and the number of fine grooves 713 turned by the help of the matching piece 72.

Figure 8:
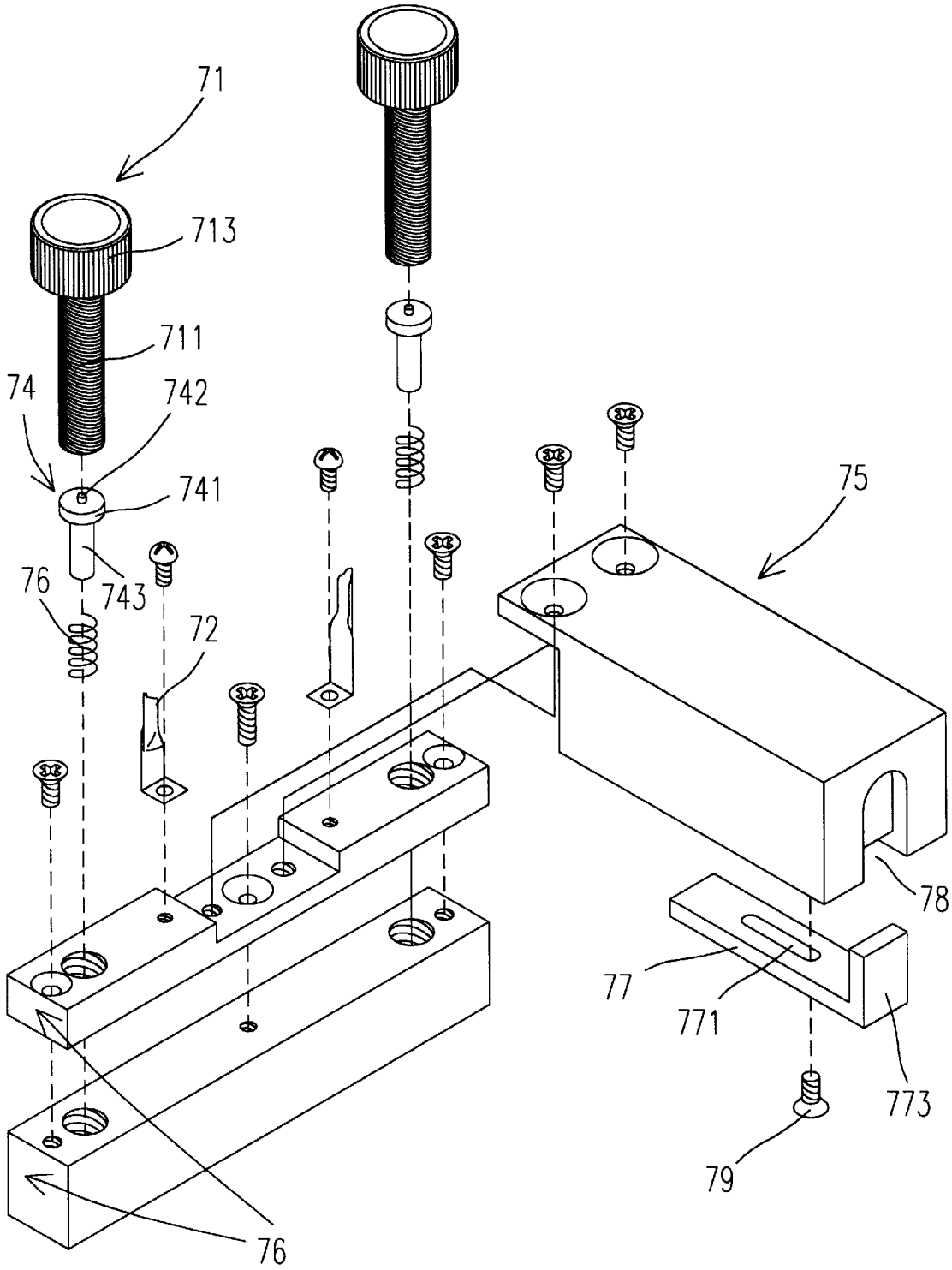
FIG. 8 is an exploded view showing a T-shaped polishing tool in FIG. 7.

FIG. 8 is an exploded view showing the relative positions of a base 76, the holding unit 75, and an adjusting assembly. Certainly, the base 76 can be integrally formed into a piece.

The adjusting assembly further includes two footing pieces 74 wherein each of them has a tail cone 742 at one end which is contacted with the lower end of a screw bolt 71 by point to surface. The T-shaped footing pieces 74 are urged by the screw bolts 71 respectively in a forward direction to adjust the orientation of the specimen 14 relative to the top surface of the polishing wheel 13 in order to control the thickness and uniformity of the specimen 14. The footing pieces 74 are located underneath the screw bolts 71 respectively and the specimen 14 is polished simultaneously by the polishing wheel 13. The Teflon-made footing pieces 74, which is softer than metals and is advantageously resistant to abrasion, will not scrape out the specimen 14 even though some Teflon particles may fall on the polishing wheel 13 during polishing.

Since the footing piece 74 is point-contacted with the screw bolt 71 which results in a smaller friction between the footing pieces 74 and the screw bolts 71 than that of a surface-to-surface contact, a synchronously spiral rotation of the footing pieces 74 and the screw bolts 71 during feeding can be avoided. By employing the principle of three points deciding a plane, i.e. the specimen 14 and two footing pieces 74 making a plane, together with the screw bolts 71 for controlling the positions of the footing pieces 74, a high quality ultra-thin specimen with a desirably specific area can be obtained. The footing piece 74 is in a T-shape and has a flange 741 connected to a coil spring 76 which urges the footing pieces 74 in a linear reverse direction by the relieving motion as the screw bolt 71 is turned backwardly.

Figure 9:
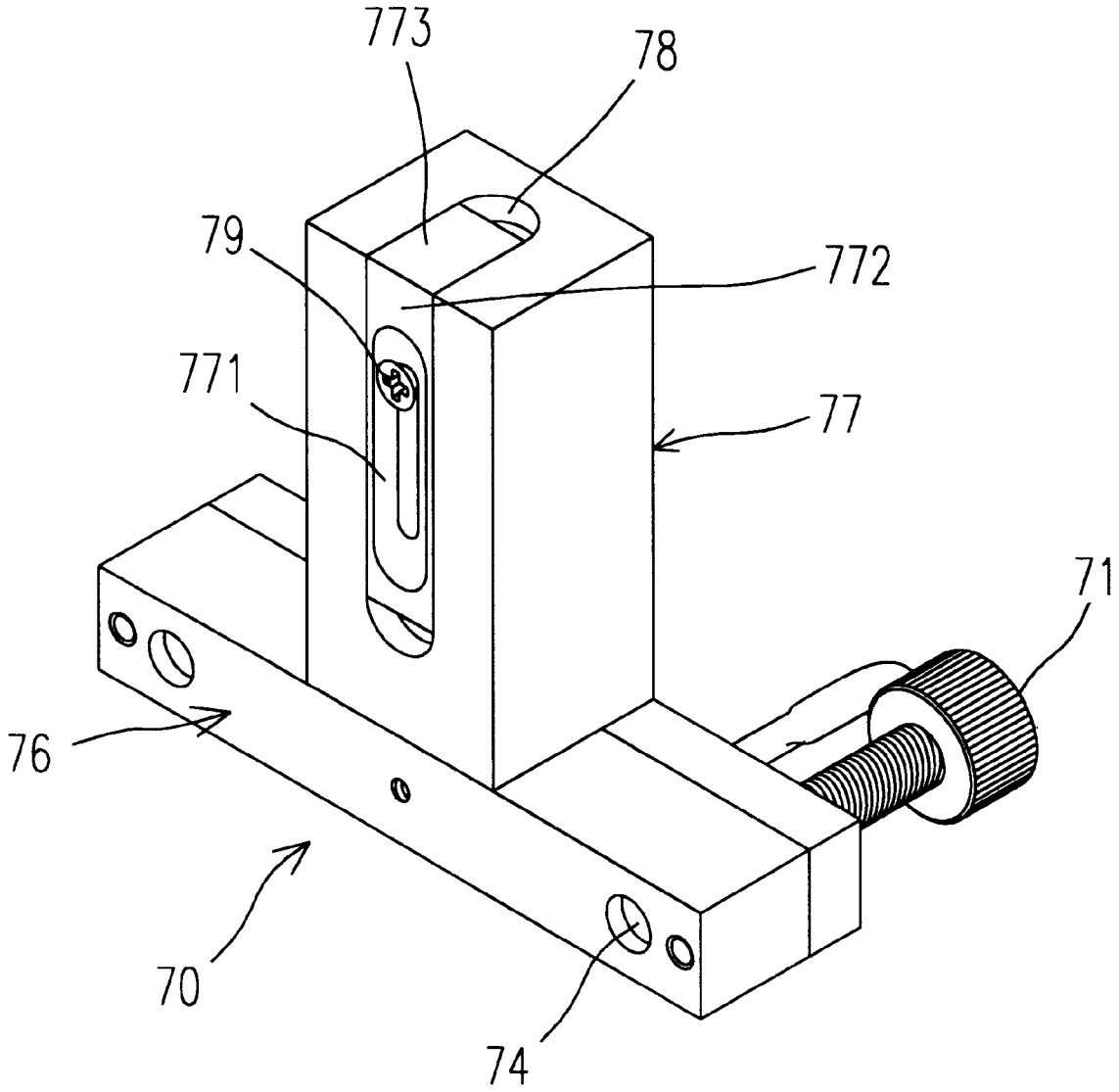
FIG. 9 is a rear perspective view showing a T-shaped polishing tool in FIG. 7.

As shown in FIG. 8, the holding unit 75 has a movable L-shaped holder 77. The L-shaped holder 77 is movable along the longitudinal direction of the holding unit 75. The L-shaped holder 77 includes a V-shaped slot 771 for fixing the L-shaped holder 77 to the holding unit 75 by a V-shaped screw 79 through the slot 771. A plan view specimen can be adhered to the first side 772 (see FIG. 9) of the L-shaped holder 77 while a cross section specimen can be adhered to the second side 773 of the movable holder 77. A groove 78 is milled on the holding unit 75 for accommodating the L-shaped holder 77. The V-shaped slot 771 is made such that it is possible to adjust the distances between a specimen 14 stuck to the L-shaped holder 77 and the footing pieces 74 and increase the accuracy in thickness and uniformity of the specimen 14.

Thus, the design according to the present invention has three advantages: (1) the footing pieces 74 do not rotate with the screw bolts 71 during the forward or backward motion, (2) the positions of the footing pieces 74 are controlled by the matching piece 72 during the forward or backward motion, (3) the L-shaped holder 77 is movable and is used for adhering thereon plane view specimen and cross section specimen.

While the invention has been described in terms of what are presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An apparatus for preparing an ultra-thin specimen with a polishing wheel, comprising:

a base;

a holding unit mounted on said base and having a movable part for supporting said specimen; and an adjusting assembly attached to said base for adjusting an orientation of said specimen relative to a top surface of said polishing wheel by providing a fine movement during polishing, wherein said adjusting assembly includes a screw bolt having a cylindrical bolt head circumferentially arranged with a plurality of fine grooves on a cylindrical surface of said bolt head and a threaded rod with fine pitch for providing said fine movement during polishing said specimen and a matching piece for engaging with one of said plurality of fine grooves to fix a position of said screw bolt; and said movable part of said holding unit is moved away from said adjusting assembly to enlarge a latitudinal cross-section of said apparatus so as to increase the precision of said orientation.

2. The apparatus according to claim 1 wherein said base, said holding unit, and said adjusting assembly are combined to form a T-shaped polishing tool.

3. The apparatus according to claim 1 wherein said holding unit comprises a groove for accommodating said movable part.

4. The apparatus according to claim 3 wherein said movable part is in a shape of L and has a slot for fixing said movable part to said holding unit by a screw through said slot.

5. The apparatus according to claim 4 wherein said specimen is adhered to a first side of said movable part so as to polish a top surface of said specimen.

6. The apparatus according to claim 4 wherein said specimen is adhered to a second side of said movable part so as to polish a side surface of said specimen.

7. The apparatus according to claim 1 wherein said adjusting assembly further comprises a footing peice having at one end a tail cone which is contacted with a lower end of said screw bolt in a forward derection to adjust said orientation of said specimen relative to said top surface of said polishing wheel.

8. The apparatus according to claim 7 wherein a coil spring is connected underneath a flange of said footing piece to urge said footing piece in a linear reverse direction by a relieving motion.

9. The apparatus according to claim 8 wherein said footing piece is a cross-sectionally T-shaped.

10. The apparatus according to claim 9 wherein said footing piece is made of Teflon.

11. The apparatus according to claim 7 wherein said matching piece is a spring leaf made of copper.

12. The apparatus according to claim 7 wherein said screw bolt is a non- skid bolt.

13. The apparatus according to claim 1 wherein said base and said holding unit are made of aluminum.

* * * * *